US011004632B1

(12) United States Patent
Liu et al.

(10) Patent No.: US 11,004,632 B1
(45) Date of Patent: May 11, 2021

(54) VACUUM ARC EXTINGUISHING CHAMBER CONTACT, VACUUM ARC EXTINGUISHING CHAMBER AND VACUUM CIRCUIT BREAKER

(71) Applicant: Beijing Orient Vacuum Electric Co., Ltd., Beijing (CN)

(72) Inventors: Weirong Liu, Beijing (CN); Xin Chang, Beijing (CN)

(73) Assignee: Beijing Orient Vacuum Electric Co., Ltd., Beijing (CN)

( * ) Notice: Subject to any disclaimer, the term of this patent is extended or adjusted under 35 U.S.C. 154(b) by 0 days.

(21) Appl. No.: 16/841,699

(22) Filed: Apr. 7, 2020

(30) Foreign Application Priority Data

Jan. 20, 2020 (CN) ..... 202010066151.2

(51) Int. Cl.
*H01H 1/06* (2006.01)
*H01H 33/666* (2006.01)

(52) U.S. Cl.
CPC ..... *H01H 33/666* (2013.01); *H01H 1/06* (2013.01)

(58) Field of Classification Search
CPC ..... H01H 33/02; H01H 33/04; H01H 33/18; H01H 33/664; H01H 33/6642; H01H 33/6644; H01H 33/6645; H01H 33/66; H01H 33/662; H01H 33/66261; H01H 2033/66223; H01H 33/6643; H01H 33/6641; H01H 33/6646
USPC ..... 218/118, 123, 127, 128, 129, 138, 141
See application file for complete search history.

(56) References Cited

U.S. PATENT DOCUMENTS 3,368,023 A * 2/1968 Dimock, Jr. ..... H02P 3/08 174/50.5
4,210,790 A * 7/1980 Kurosawa ..... H01H 33/6644 218/127
5,064,976 A * 11/1991 Bialkowski ..... H01H 33/6642 218/127
5,804,788 A * 9/1998 Smith ..... H01H 33/6644 218/129
6,649,855 B2 * 11/2003 Nishijima ..... H01H 33/6642 218/123

(Continued)

FOREIGN PATENT DOCUMENTS

DE 112010005149 * 10/2012 ..... H01H 33/66

OTHER PUBLICATIONS

Translation DE112010005149 (Original document published Oct. 25, 2012) (Year: 2012).*

*Primary Examiner* — William A Bolton
(74) *Attorney, Agent, or Firm* — JCIP Global Inc.

(57) ABSTRACT

The invention relates to a vacuum arc extinguishing chamber contact, a vacuum arc extinguishing chamber and a vacuum circuit breaker. The contact includes a contact blade, a first contact cup and a second contact cup. The first contact cup is arranged in the second contact cup. One end of the first contact cup is connected with the second contact cup, and the other end of the first contact cup is connected with the contact blade. The contact blade is connected with the second contact cup. According to the invention, a single longitudinal magnetic field is split into a plurality of independent longitudinal magnetic field areas, a plurality of coils are used for shunting current, and the current density is reduced, thereby solving the contradiction between interrupting of the large short-circuit current and the temperature rise of the large rated current.

11 Claims, 3 Drawing Sheets

(56) References Cited

U.S. PATENT DOCUMENTS

| | | | | |
|---|---|---|---|---|
| 7,906,742 | B2 * | 3/2011 | Steffens | H01H 33/6642 218/126 |
| 8,164,019 | B2 * | 4/2012 | Schlaug | H01H 33/6642 218/129 |

* cited by examiner

VACUUM ARC EXTINGUISHING CHAMBER CONTACT, VACUUM ARC EXTINGUISHING CHAMBER AND VACUUM CIRCUIT BREAKER

CROSS-REFERENCE TO RELATED APPLICATION

This application claims the priority benefit of China application No. 202010066151.2, filed on Jan. 20, 2020. The entirety of the above-mentioned patent application is hereby incorporated by reference herein and made a part of this specification.

BACKGROUND

Technical Field

The invention belongs to the technical field of vacuum switches, and particularly relates to a vacuum arc extinguishing chamber contact, a vacuum arc extinguishing chamber and a vacuum circuit breaker of medium or high voltage equipment.

Description of Related Art

In power distribution networks, a switchgear functions to provide control or protection. Therefore, the switchgear is an important part which must be used in the circuit, and it plays a role in switching on or off the circuit. In recent years, due to the advantages of strong interrupting capacity, environmental protection, no explosion hazard, small contact gap, extremely high electrical life and the like of the vacuum circuit breaker, the vacuum circuit breaker has occupied an overwhelming position in the application of the medium-voltage field.

A core component of the vacuum circuit breaker is a vacuum arc extinguishing chamber in an insulating shell. The vacuum arc extinguishing chamber comprises a movable contact, a fixed contact, a movable conductive rod and a fixed conductive rod, wherein the movable contact and the fixed contact are mechanically separated by manipulating the movable conductive rod via an operating mechanism. When the contacts are separated, the contact area of the contact is smaller until the contact is melted, evaporated and ionized; and discharge in vacuum is maintained in metal vapor, thereby generating a vacuum arc; and finally the contacts are electrically disconnected. The contact is provided with a system for generating a magnetic field, which is used for forming a transverse magnetic field or a longitudinal magnetic field between the contacts when the vacuum arc extinguishing chamber breaks short-circuit current, so that the formation of anode spots on the surface of the contact is prevented, and the interrupting capacity of the arc extinguishing chamber is improved.

In order to improve the interrupting capacity of the vacuum arc extinguishing chamber, a longitudinal magnetic field is required to be applied to the vacuum arc, so that the vacuum arc is kept in a stable and diffused state. The current can be uniformly dispersed on the surface of the contact, the temperature rise of the surface of the contact can be less, and a large amount of material of the contact surface is evaporated. The arc voltage is kept at a low level to reduce the electric wear of the contact. Therefore, the contact must have the ability of arcing, conducting electricity, and generating magnetic fields, and technical parameters thereof should meet the requirements of good welding resistance, high withstand voltage strength, large interrupting current capability, good arc ablation resistance, low cutoff value, low gas content, high conductivity, small geometric size, high reliability and the like.

At present, with the development of economy, vacuum circuit breakers with high rated current (6300 A or more) and large short-circuit current (80 KA or more) are more and more demanded in high-voltage distribution circuits. The vacuum arc extinguishing chamber is a key component of the vacuum circuit breaker and directly determines whether it can meet the requirements of the electrical parameters. When interrupting the short-circuit current with 80 KA or more, the contacts of the vacuum arc extinguishing chamber usually adopts a longitudinal magnetic field system. It is necessary for the contacts to generate a strong longitudinal magnetic field to control the arc generated by the gap between the movable contact and the fixed contact, so that it burns on a large enough contact surface. At present, the vacuum arc extinguishing chamber with both high rated short-circuit current and high short-circuit interrupting current is still in a technical blank stage, and there is no vacuum arc extinguishing chamber with corresponding contacts can meet the requirements on the market. According to conventional practice in the art, in order to have such a large short-circuit current interrupting capacity, it is necessary to increase the diameter of a contact coil forming a longitudinal magnetic field, the rotation length of the coil, and the diameter of the contact. However, as the diameter of the coil and the rotation length of the coil are increased, on the one hand, the loop resistance must be increased greatly, and the heating of the vacuum arc extinguishing chamber having it must be serious when the rated current is conducted, which cannot meet the type test requirements; on the other hand, as the diameter and the rotation length of the coil are remarkably increased, the manufacturing process can be very complicated, and the manufacturing cost can be greatly increased.

In summary, the prior art cannot provide a vacuum arc extinguishing chamber capable of simultaneously interrupting large short-circuit current and carrying large rated current for a long time, which is blank in the field.

SUMMARY

The invention is directed to solve the problem that it is difficult for an existing vacuum arc extinguishing chamber to give consideration to both interrupting of the large short-circuit current and temperature rise of the large rated current. The invention provides a vacuum arc extinguishing chamber contact and a vacuum arc extinguishing chamber which give consideration to both high rated short-circuit current and high short-circuit interrupting current. In order to achieve the above object, the present invention adopts the following technical scheme.

A vacuum arc extinguishing chamber contact comprises a contact blade, a second contact cup, a first contact cup, a reinforcing rib and a magnetic collecting ring. One or two or more first contact cups are arranged in the second contact cup, and a number of the first contact cup is generally more than two. When more than two first contact cups are arranged, the first contact cups are uniformly distributed in the second contact cup, and a gap exists between two adjacent first contact cups.

The walls of the second contact cup and the first contact cup are respectively provided with a plurality of chutes which are at least three to change a current direction and form a longitudinal magnetic field within a diameter range thereof. A magnetic collecting ring is arranged in each first contact cup to reinforce the longitudinal magnetic field and play an auxiliary supporting role on the contact blade, and the reinforcing rib is arranged in a center of the second contact cup to play a main supporting role on the contact blade. When the arc burns between the first contact blade and the second contact blade, the current is distributed to the second contact cup and each first contact cup, and is collected to the conductive rod, so that a plurality of longitudinal magnetic fields are formed between two vacuum arc extinguishing chamber contacts, the arc burns on a larger contact face as much as possible to break larger short-circuit current.

The first contact cup is connected with an inner surface of the bottom of the second contact cup. The contact blade is simultaneously connected with the second contact cup and each first contact cup. Therefore, when the current flows through the contact blade, the current is distributed to the second contact cup and each first contact cup to carry out through-flow, so that the current flowing and carrying capacity of the contact is remarkably improved. Meanwhile, when the vacuum arc extinguishing chamber provided with the contact breaks the short-circuit current, the short-circuit current is also shunted to the second contact cup and each first contact cup, so that a strong longitudinal magnetic field is formed in the area corresponding to each first or second contact cup, and the short-circuit arc is controlled to be dispersed to the control area of each longitudinal magnetic field for burning, as a result of which the arc of the short-circuit current can be well extinguished. Therefore, the contact perfectly solves the contradiction between interrupting large short-circuit current and flowing and carrying large rated current for a long-time.

The second contact cup can be used as a carrier for the first contact cup and the contact blade, and can also be used as a conductive connector between the contact and the conductive rod of the vacuum arc extinguishing chamber.

The reinforcing rib is arranged in the middle of the second contact cup to support the contact blade. The magnetic collecting ring is arranged in the middle of each first contact cup, so that the magnetic field can be strengthened, and meanwhile, the contact blade can be supported.

The vacuum arc extinguishing chamber comprises a first conductive rod, a second conductive rod, a first contact, a second contact, a first end cap, a second end cap, a grading ring of a first end, a grading ring of a second end, an insulating shell, a main shielding cover, a corrugated pipe, a shielding cover of the corrugated pipe, a guide sleeve and a positioning ring of the guide sleeve. The first contact and the second contact are identical, namely the vacuum arc extinguishing chamber contact. The first conductive rod is connected with the first contact, and the second conductive rod is connected with the second contact. The first conductive rod is connected with the first end cap, the first end cap is connected with the first grading ring, and the first grading ring is connected with the insulating shell. The second conductive rod is connected with the shielding cover of the corrugated pipe, the shielding cover of the corrugated pipe is connected with one end of the corrugated pipe, and the other end of the corrugated pipe is connected with the second end cap, and the second end cap is connected with the grading ring of the second end. The grading ring of the second end is connected with one end of the insulating shell.

The vacuum circuit breaker comprises the vacuum arc extinguishing chamber, and the vacuum arc extinguishing chamber comprises the contact structure of the vacuum arc extinguishing chamber.

According to the technical scheme, by arrangement of a plurality of coil-shaped contact cups in the contact, a single longitudinal magnetic field is split into a plurality of independent longitudinal magnetic field areas, and each contact cup can shunt current, so that the electric arcs generated between the movable contact and the fixed contact when the vacuum arc extinguishing chamber breaks large short-circuit current are dispersed to a plurality of contact material areas controlled by the longitudinal magnetic field for burning. The vacuum arc extinguishing chamber using the contacts will have greater ability to break short-circuit current. Meanwhile, when the vacuum arc extinguishing chamber conducts and carries large rated current, due to the fact that the current is distributed to a plurality of contact cups to flow, a plurality of coils are used for shunting the current, and the current density is reduced. When the vacuum arc extinguishing chamber conducts and carries large rated current, the vacuum arc extinguishing chamber has less temperature rise, and the heating of the contacts is obviously reduced, solving the contradiction between interrupting of the large short-circuit current and temperature rise of the large rated current. Moreover, the contact has the following advantages: simple machining process, easy implementation and low production cost.

To make the aforementioned more comprehensible, several embodiments accompanied with drawings are described in detail as follows.

BRIEF DESCRIPTION OF THE DRAWINGS

The accompanying drawings are included to provide a further understanding of the disclosure, and are incorporated in and constitute a part of this specification. The drawings illustrate exemplary embodiments of the disclosure and, together with the description, serve to explain the principles of the disclosure.

DESCRIPTION OF THE EMBODIMENTS

The present invention now will be described more clearly and fully hereinafter with reference to the accompanying drawings, in which it is apparent that the described embodiments are only a few, but not all embodiments of the invention. Based on the embodiments of the present invention, all other embodiments obtained by a person of ordinary skill in the art without involving any inventive effort are within the scope of the present invention.

Now, as mentioned in the background art, a product which realizes such a large current interrupting capacity and can conduct and carry a rated current of 6300 A for a long time has not yet appeared in the field. In the conventional theory, the diameter of a contact and the rotation angle of a coil arranged below a contact blade are increased to increase the magnetic field strength so as to meet the interrupting capacity of such a large short-circuit current. However, after the rotation angle of the coil is increased, it would be difficult to process, causing a main thing that the current path is obviously increased and the resistance of the contact becomes large. Therefore, the vacuum arc extinguishing chamber is difficult to conduct and carry a large rated current, and causes serious heating, which cannot meet the type test and normal operation requirements.

Embodiment I

The vacuum arc extinguishing chamber contact of the embodiment is applied to a vacuum arc extinguishing chamber of vacuum circuit breaker at a generator outlet, and the design specification is as follows: rated voltage: 24 KV, rated current: 6300 A, and rated short-circuit interrupting current: 90 KA. The vacuum arc extinguishing chamber contact comprises one second contact cup 5, three first contact cups 4 and one contact blade 1. The three first contact cups 4 are all cylindrical and uniformly distributed on an inner bottom surface of the second contact cup 5, and a gap exists between two adjacent first contact cups 4. A wall of the second contact cup 5 is provided with three chutes. A wall of the first contact cup 4 is provided with three chutes. The chutes of the first contact cup 4 and the second contact cup 5 are arranged on the outer surface of the wall and do not penetrate through the wall. The chutes incline in an arc shape from bottom to top of the cup, and are uniformly distributed. The bottom of each first contact cup 4 is brazed with the inner bottom surface of the second contact cup 5, and an upper end surface of each first contact cup 4 and an upper end surface of the second contact cup 5 are positioned at the same height and brazed with the contact blade 1.

Embodiment II

Figure 1:
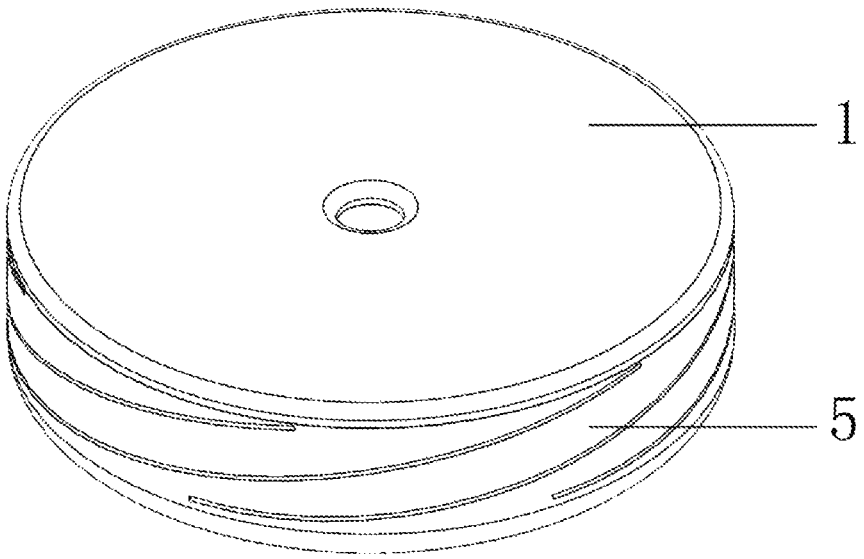
FIG. 1 is an overall external schematic diagram of a vacuum arc extinguishing chamber contact of embodiments I-III of the present invention.
Figure 2:
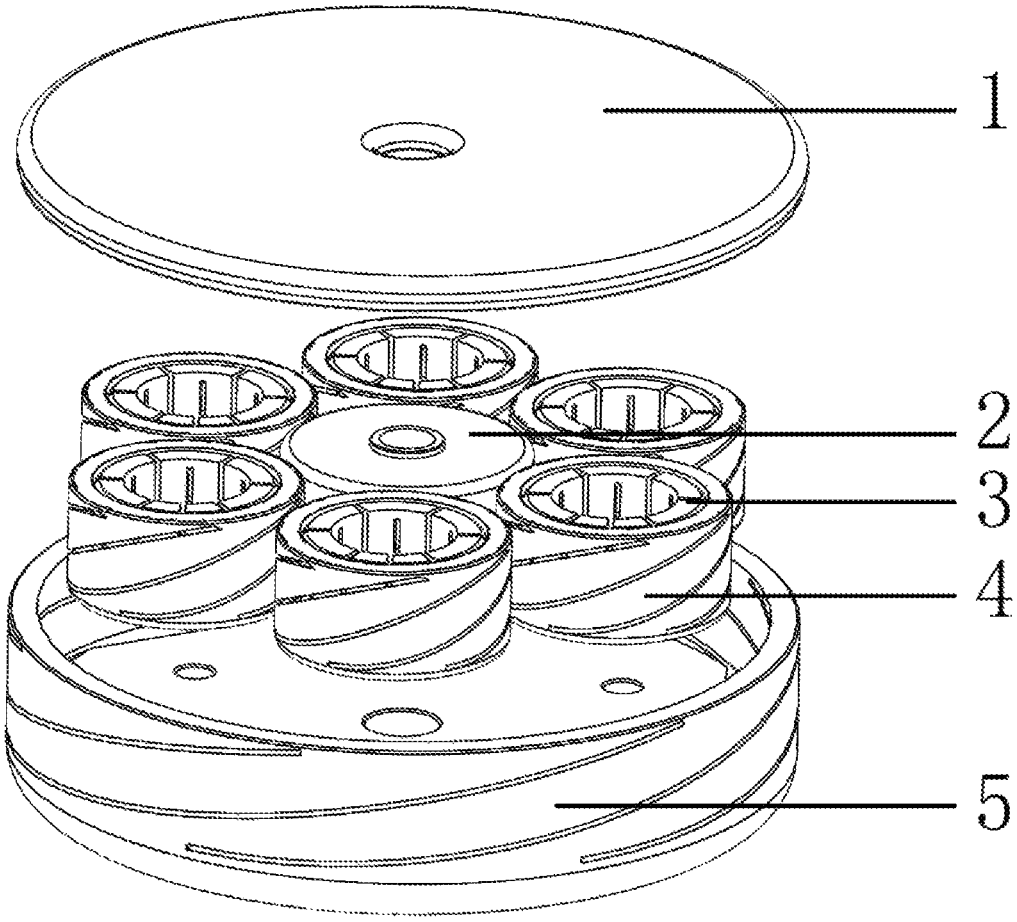
FIG. 2 is an internal structure diagram of the vacuum arc extinguishing chamber contact in the embodiment II of the present invention.

As shown in FIG. 1 and FIG. 2, the vacuum arc extinguishing chamber contact of the embodiment is applied to a vacuum arc extinguishing chamber of vacuum circuit breaker at a generator outlet, and the design specification is as follows: rated voltage: 24 KV, rated current: 6300 A, and rated short-circuit interrupting current: 90 KA. The vacuum arc extinguishing chamber contact comprises one second contact cup 5, six first contact cups 4, one contact blade 1, six magnetic collecting rings 3 and one reinforcing rib 2.

The magnetic collecting ring 3 is made of electrical pure iron with high magnetic permeability, the second contact cup 5 is made of copper with high conductivity, and the reinforcing rib 2 is made of stainless steel.

The magnetic collecting ring is annular, and deep grooves are uniformly distributed and axially formed in the annular ring.

The six first contact cups 4 have annular cross sections and are uniformly distributed on the inner bottom surface of the second contact cup 5, and a gap exist between two adjacent first contact cups 4. The wall of the second contact cup 5 is provided with four chutes. The wall of each of the first contact cups 4 is provided with five chutes. The bottom of each first contact cup 4 is brazed with the inner bottom surface of the second contact cup 5, and the upper end surface of each first contact cup 4 and the upper end surface of the second contact cup 5 are positioned at the same height and brazed with the contact blade 1.

The magnetic collecting rings 3 are arranged in the six first contact cups 4 so as to enhance the longitudinal magnetic field formed by each first contact cup 4. The reinforcing rib 2 is arranged at the center of the second contact cup 5 and plays a supporting role between the contact blade 1 and the reinforcing rib 2.

Embodiment III

The vacuum arc extinguishing chamber contact of the embodiment is applied to a vacuum arc extinguishing chamber of vacuum circuit breaker at a generator outlet, and the design specification is as follows: rated voltage: 24 KV, rated current: 6300 A, and rated short-circuit interrupting current: 90 KA. The vacuum arc extinguishing chamber contact comprises one second contact cup 5, six first contact cups, one contact blade 1, six magnetic collecting rings and one reinforcing rib 2.

The six first contact cups are all horseshoe-shaped assemblies capable of generating longitudinal magnetic fields and are uniformly arranged on the inner bottom surface of the second contact cup 5, and a gap exists between two adjacent first contact cups 4.

The second contact cup 5 is made of a copper material with high conductivity, and four chutes are formed in the wall of the second contact cup 5. The wall of the first contact cup and the wall of the second contact cup 5 are also provided with four chutes. The bottom of each first contact cup is brazed with the inner bottom surface of the second contact cup 5, and the upper end surface of each first contact cup and the upper end surface of the second contact cup 5 should be positioned at the same height and brazed with the contact blade 1.

The six first contact cups are internally provided with magnetic collecting rings. The magnetic collecting rings are annular, and the annular rings are axially provided with straight grooves which penetrate through the inside and the outside of the annular rings. In order to enhance the longitudinal magnetic field formed by each first contact cup, the magnetic collecting ring is made of electrical pure iron with high magnetic permeability.

The reinforcing ribs 2 is arranged at the center of the second contact cup 5, is made of stainless steel and plays a supporting role between the contact blade 1 and the reinforcing rib 2.

Embodiment IV

Figure 3:
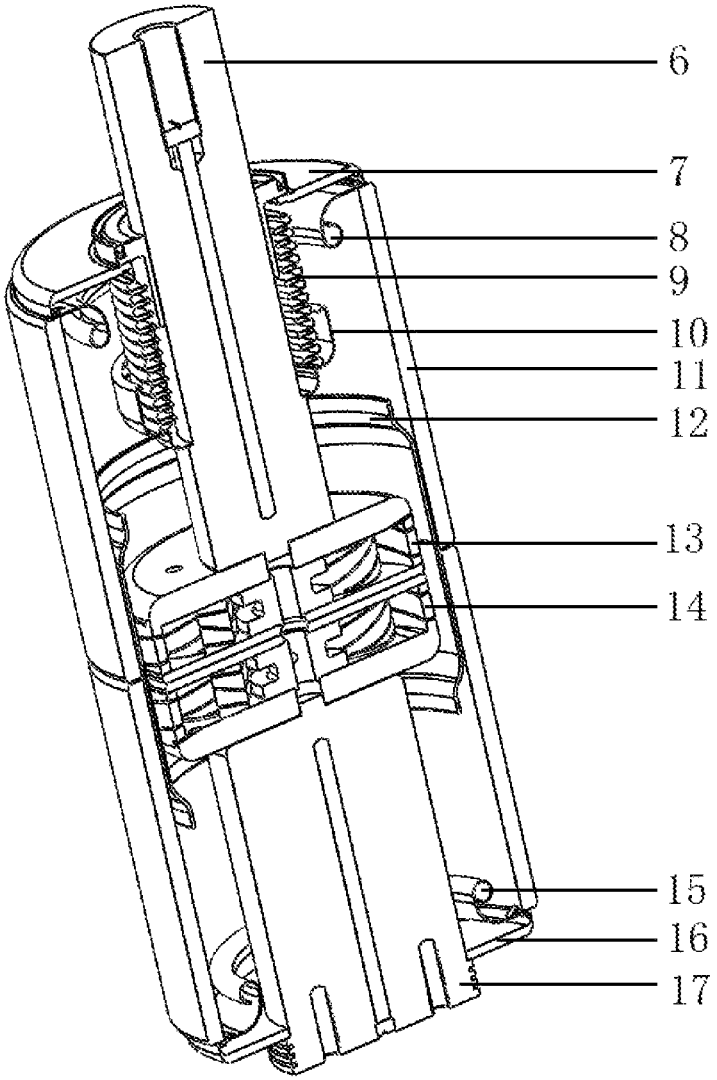
FIG. 3 is an axial sectional view of the vacuum arc extinguishing chamber of embodiment IV of the present invention.

The vacuum arc extinguishing chamber shown in FIG. 3 comprises a first conductive rod 6, a second conductive rod 17, a first contact 13, a second contact 14, a first end cap 7, a second end cap 16, a grading ring 8 of a first end, a grading ring 15 of a second end, an insulating shell 11, a main shielding cover 12, a corrugated pipe 9, a shielding cover of the corrugated pipe 10, and a guide sleeve. The first contact 13 and the second contact 14 are identical, and the internal structure of the contact is the same as that of the embodiment 1, which will not be described in detail. The first conductive rod 6 is connected with the first contact 13, and the second conductive rod 17 is connected with the second contact 14. The first conductive rod 6 is brazed with the first end cap 7, the first end cap 7 is brazed with the grading ring 8 of the first end, the grading ring 8 of the first end is brazed with the insulating shell 11, the first conductive rod 6 is brazed with the shielding cover 10 of the corrugated pipe, the shielding cover 10 of the corrugated pipe is brazed with one end of the corrugated pipe 9, and the other end of the corrugated pipe 9 is brazed with the first end cap 7. The second end cap 16 is brazed with the grading ring 15 of the second end, and the grading ring 15 of the second end is brazed with one end of the insulating shell 11, thereby forming a closed vacuum space. The guide sleeve is arranged between the first conductive rod 6 and the corrugated pipe 9, and the positioning ring of the guide sleeve is welded with the first end cap 7 and presses against the guide sleeve.

When the vacuum arc extinguishing chamber is normally operated in a closed state, the current can be introduced by the first conductive rod 6 and the second conductive rod 17, as described here in the first case. When the current flows to the second contact cup 5 of the first contact 13 from the first conductive rod 6, the current is distributed to the wall of the second contact cup 5 and the wall of each first contact cup 4, and then is converged to the contact blade 1 of the first contact. The current then flows through the contact blade 1 of the second contact 14 and is distributed to the wall of the second contact cup 5 and the wall of each first contact cup 4, and then is converged to the second conductive rod 17 and outflows to the conductive circuit in the circuit. The current at the moment is shunted by a plurality of contact cups, and the current density in each contact cup is low, so that the vacuum arc extinguishing chamber has low heat generation and long-term reliable safety operation.

When a short circuit occurs in the line and the vacuum circuit breaker is switched off to separate the two contacts of the vacuum arc extinguishing chamber, an intensive arc is generated between the first contact 13 and the second contact 14. At the moment, the current is distributed into the walls of a plurality of contact cups, and the wall of each contact cup is provided with a plurality of chutes, so that the longitudinal current is changed to the current flowing along a winding path in the wall. Therefore, a strong longitudinal magnetic field can be generated in a space corresponding to each contact cup, the electric arcs of the contact gaps can be well controlled by the plurality of magnetic field areas and dispersed to the surfaces of the contact blades 1 in a plurality of magnetic field areas for burning, and the arcs are diffused, so that when the alternating current crosses zero, the insulation capacity can be quickly restored between fractures of the vacuum arc extinguishing chamber, and the large short-circuit current can be effectively extinguished.

In this specification, various embodiments have been described in an incremental manner. Each embodiment is described with emphasis on differences from other embodiments, while the identical or similar parts of the embodiment are described with reference to one another. The above description of the disclosed embodiments is provided to enable those skilled in the art to make or use the present invention. Various modifications to these embodiments will be readily apparent to those skilled in the art, and the generic principles defined herein may be applied to other embodiments without departing from the spirit or scope of the invention. Thus, the present invention is not intended to be limited to the embodiments shown herein but is to be accorded the widest scope consistent with the principles and novel features disclosed herein.

What is claimed is:

1. A vacuum arc extinguishing chamber contact, comprising a contact blade, a plurality of first contact cups and a second contact cup, wherein the first contact cups are arranged in the second contact cup and arranged in a circumferential array with respect to a geometric center of the second contact cup, and one end of each of the first contact cups is connected with the second contact cup, and the other end of each of the first contact cups is connected with the contact blade.

2. The vacuum arc extinguishing chamber contact according to claim 1, wherein the contact blade is connected with the second contact cup.

3. The vacuum arc extinguishing chamber contact according to claim 2, wherein an upper end surface of each of the first contact cups and an upper end surface of the second contact cup are in a same plane.

4. The vacuum arc extinguishing chamber contact according to claim 3, further comprising a plurality of magnetic collecting rings respectively arranged in the first contact cups.

5. The vacuum arc extinguishing chamber contact according to claim 4, further comprising a reinforcing rib arranged in the second contact cup.

6. The vacuum arc extinguishing chamber contact according to claim 5, wherein each of the first contact cups is cylindrical or horseshoe-shaped or other coil capable of forming a longitudinal magnetic field.

7. The vacuum arc extinguishing chamber contact according to claim 1, wherein a wall of the second contact cup is provided with a chute.

8. The vacuum arc extinguishing chamber contact according to claim 7, wherein a wall of each of the first contact cups is provided with a chute.

9. A vacuum arc extinguishing chamber comprising a first conductive rod, a second conductive rod, a first end cap, a second end cap, a grading ring of a first end, a grading ring of a second end, an insulating shell, a main shielding cover, a corrugated pipe and a shielding cover of the corrugated pipe, wherein the vacuum arc extinguishing chamber comprises two vacuum arc extinguishing chamber contacts as claimed in claim 1; the first conductive rod is connected with a first contact, and the second conductive rod is connected with a second contact; the first conductive rod is connected with the first end cap, the first end cap is connected with the first grading ring, and the first grading ring is connected with the insulating shell; the second conductive rod is connected with the shielding cover of the corrugated pipe, the shielding cover of the corrugated pipe is connected with one end of the corrugated pipe, and the other end of the corrugated pipe is connected with the second end cap, and the second end cap is connected with the grading ring of the second end; and the grading ring of the second end is connected with one end of the insulating shell.

10. The vacuum arc extinguishing chamber according to claim 9, further comprising a guide sleeve and a positioning ring of the guide sleeve, wherein the guide sleeve is arranged between the first conductive rod and the corrugated pipe, and the positioning ring of the guide sleeve is connected with the first end cap and presses against the guide sleeve.

11. A vacuum circuit breaker provided with the vacuum arc extinguishing chamber as claimed in claim 10.

* * * * *